United States Patent [19]

Adamick

[11] Patent Number: 4,487,443

[45] Date of Patent: Dec. 11, 1984

[54] TOTE FOR EASY CARRYING OF BULKY, HEAVY OR ODD-SHAPED LOADS

[75] Inventor: S. Mark Adamick, Placerville, Calif.

[73] Assignee: T.B.E., Placerville, Calif.

[21] Appl. No.: 469,633

[22] Filed: Feb. 25, 1983

[51] Int. Cl.[3] ..... B65D 63/18; B65D 71/02

[52] U.S. Cl. ..... 294/151; 294/165

[58] Field of Search ..... 294/137, 138, 141–143, 294/146–151, 153–155, 157, 159, 161–167

[56] References Cited

U.S. PATENT DOCUMENTS

| | | | |
|---|---|---|---|
| 188,199 | 3/1877 | Smith | 294/142 |
| 1,847,501 | 3/1932 | Stahler | 294/157 |
| 2,907,507 | 10/1959 | Solak | 294/148 |
| 3,114,487 | 12/1963 | Miller et al. | 294/162 X |
| 3,123,264 | 3/1964 | Proctor | 294/151 |
| 3,260,430 | 7/1966 | Sandenburgh | 294/166 X |
| 3,295,733 | 1/1967 | Heal | 294/142 |
| 4,026,501 | 5/1977 | Schultz | 294/151 |

FOREIGN PATENT DOCUMENTS

| | | | |
|---|---|---|---|
| 1152628 | 2/1958 | France | 294/148 |

*Primary Examiner*—Johnny D. Cherry

*Attorney, Agent, or Firm*—Wagner & Bachand

[57] ABSTRACT

A tote 10 comprises a rack 12 and a strap assembly 14. The rack 12 has a generally rectangular wall portion 32 and a foot 50 projecting outwardly therefrom to support a load held to the rack wall portion by the several webs 16 and plates 18, 20 of the strap assembly. Handle 52 is offset from the plane of the wall portion 32 and cantilevered over the center of the foot 50 for balancing the load in the user's hand.

14 Claims, 4 Drawing Figures

TOTE FOR EASY CARRYING OF BULKY, HEAVY OR ODD-SHAPED LOADS

TECHNICAL FIELD

This invention has to do with means for easily carrying bulky, heavy and/or odd shaped loads, such as fireplace logs and quarters of baled hay. More particularly, the invention is concerned with provision of a tote comprising a rack and strap assembly which is readily adapted to portage of differently shaped loads by hand, conveniently and comfortably at the side of an individual. The tote in addition to being adaptable to different loads carries all loads both balanced and offset from the body, reducing the strain on the arm being used to carry the load and eliminating much of the abrasive contact with the leg that used to characterize carrying such loads when they could be carried to the side at all.

The present tote is designed to carry firewood or hay bale quarters, packages of surveyors' instruments or other heavy, bulky, or oddly shaped load conveniently at the side without fatiguing the arm by attempting to hold the load from the body, or rubbing against the leg while walking for balance.

BACKGROUND ART

A number of devices have been proposed for holding or carrying objects which involve a rack and a retaining system such as a strap or clip. Among these is the book carrier device described in U.S. Pat. No. 3,295,733 to Heal having a backing and a shelf to support books and an elasticized retainer. The Heal device is apparently intended and in fact limited to carriage of small loads such as books in that the inventor shows no recognition of the problem arising when attempting to carry heavy or bulky loads, i.e. the problem of lack of balance in the load which makes carrying awkward and uncomfortable. The early patent to Smith, U.S. Pat. No. 188,199, is similar in teaching a holder and handle for carrying books and the like with no recognition for a different deign when large loads such as hay bale quarters are to be carried about. In U.S. Pat. No. 4,026,501 to Schultz a typewriter carrier is disclosed which typifies the previous impractical approaches in the art to toting heavy loads. It will be noted that Schultz proposes holding the load, a typewriter, cantilevered from the body, causing a pivoting moment about the handle and likely causing the carrier inward edge to bear against the person. Moreover the Schultz handle placement does nothing to ameliorate the pivoting moment. In practice, such a carrier would be used by holding the carrier well out from the body, and awkward and tiring position. In U.S. Pat. No. 2,907,507 to Solak and U.S. Pat. No. 2,688,408 to Binggely special purpose carriers or totes are shown, neither of which appears to appreciate the need for a different design when more than token weight or bulk is contemplated to be carried. Neither patent discloses a design useful for large or quite heavy loads which may have to be carried a good distance without arm fatigue or abrading the leg.

SUMMARY OF THE INVENTION

It is a major object of the invention to provide a tote which enables the easy portage of heavy, bulky or oddly shaped loads at the side and without straining the arm or interfering with walking. It is another object to provide a rack and strap assembly which supports a load for easy carrying and which is constructed to balance the load without need of holding the tote away from the body. It is still another object to provide a versatile carrier for such loads which is widely adaptable to different strapping patterns relative to a common rack and which is adjustable for loading and then binding the load on the rack. It is a further object to provide a unitary molded body defining such a rack with integral foot support and offset handle features to accomplish the objects of the invention. Yet another object is the provision of a uniquely suitable strapping system in which the straps are segmented for optimum lay-flat on the load, and securement to the rack without twisting or kinking.

These and other objects of the invention to become apparent hereinafter are realized in a tote for carrying bulky, heavy and/or oddly shaped loads, comprising a rack and strap assembly adapted to support a load for comfortable carrying by hand alongside a user's leg, the strap comprising an elongated, flexible web means cooperating with the rack in load retaining relation, the rack comprising a normally upright vertically and horizontally extended wall portion, an outwardly projecting foot portion rigidly connected to the bottom of the wall portion to underlie the load in supporting relation, and handle means cantilevered from the top of the wall portion to oppose the foot portion outward from the wall portion and in spaced relation across the vertical extent of the wall portion, whereby bulky, heavy and/or oddly shaped loads are hand-holdable in offset relation from the user's leg for increased ease in carrying.

In particular embodiments, the handle extends vertically above the wall portion top, and there is further included a continuation of the wall portion extending upwardly beyond the wall portion to the handle to support the same in cantilevered relation; there are additionally provided retainers for the strap web means, the retainers comprising cooperating sets of web-passing apertures defined in the wall portion at spaced locations enabling encircling of a load by the strap web means in retained relation; the rack wall portion defines a series of angularly related fixed retainers for the strap web means, the strap web means comprising a series of flat web sections and coupling plates therefor adapted to interconnect the web sections in fixed retainer-determined angular relation against twisting and kinking of the web sections when binding the load to the rack; and a strap fastener means is provided carried by the wall portion for releasably retaining more or less of the strap web means in load-binding relation.

In particularly preferred embodiments, there is provided a tote for carrying bulky, heavy and/or oddly shaped loads, comprising a rack and strap assembly adapted to support a load being carried by hand alongside a user's leg, the rack being a unitary molding of high strength synthetic organic plastic and comprising a normally upright, generally rectangular, wall portion having a top and a top edge margin adjacent thereto, side edges and side edge margins adjacent thereto, and a bottom edge and a bottom edge margin adjacent thereto, a foot portion integrally formed with and normally projecting outwardly from the wall portion bottom edge for supporting a load to be carried, and a handle integrally formed with and cantilevered from the top edge of the wall portion offset from the plane of the wall portion to overlie the foot portion; strap retaining means being formed in the wall portion top and bottom edge margins; the strap being retained at the retaining means in length adjustable relation for urging a load against the wall portion in foot portion supported relation, whereby bulky, heavy and oddly shaped loads are supported and balanced on the rack for easy carrying.

In such and like embodiments, there is further included side and top edge margin flanges reinforcing the wall portion against edge flexing, and central rib means reinforcing the wall portion against flexing between the flanges; increased cross-section at the top and bottom edge margins of the wall portion, the retainers being defined within the edge margins of increased cross-section; the central rib reinforced portion of the wall portion has an upward and outward continuation defining a support for the handle; the wall portion defines a perimetrically distributed series of retainers including a retainer adjacently below the continuation at the wall portion top edge margin, and additional retainers at the wall portion bottom edge margin adjacently above the foot portion, the additional retainers being defined by spaced, strap passing apertures in the wall portion edge margins; the strap comprises a first section and a fastener therefor at the top edge margin, second and third strap sections looped respectively around left and right bottom edge margin retainers, and means buckling the second and third sections in looped connection with the retainers; the first section fastener comprises a friction buckle mounted to the back of the wall portion adapted to bind the first strap section to the wall portion anywhere along the length of the first section whereby the strap is length adjustable in secured relation; the first, second and third strap sections are relatively triangularly disposed, and including also a floating plate interconnecting the strap sections in the triangular relation, the plate and the strap sections engaging the load for toting; and the second and third strap section retainers lie parallel with the wall portion bottom edge margin and the strap sections extend angularly across the wall portion, and including also means maintaining the second and third strap sections flat against the load and free of twists and kinks, the means comprising secondary plates interposed between adjacent segments of the strap sections to define an angular interconnection between the segments enabling the segments to lie flat against the load and to fully engage the section retainers across the width of the strap section.

In a highly particularly preferred embodiment, there is provided a tote for carrying bulky, heavy and/or oddly shaped loads, comprising a rack and strap assembly, the strap assembly including a plurality of woven webs articulated along their length to angularly traverse the load but meet the rack at right angles in the plane of the web and lie flat upon the load free of twisting and kinking; the rack comprising a molded generally planar body having a bottom edge flange adapted to underlie a load in supporting relation, and a top edge handle offset from the plane of the rack body to carry the load in cantilevered relation, the rack body having a perimetrical rib at the sides and top thereof, and a pair of central ribs running from the handle to the bottom edge flange, the perimetrical side ribs and the central ribs continuing across the flange in reinforcing relation, a plurality of strap retainers at the top, bottom and side edge margins of the rack body comprising a bar adapted to be looped with the strap webs, buckle means adjustably securing the webs to themselves in looped relation, and a releasable lock for lengthwise adjusting the strap free of adjusting the buckle means, the lock being positioned on the back side of the rack body and adapted to receive a strap web tab in adjustable locking relation.

THE DRAWINGS

The invention will be further described with reference to the attached drawings in which.

PREFERRED MODES

Figure 1:
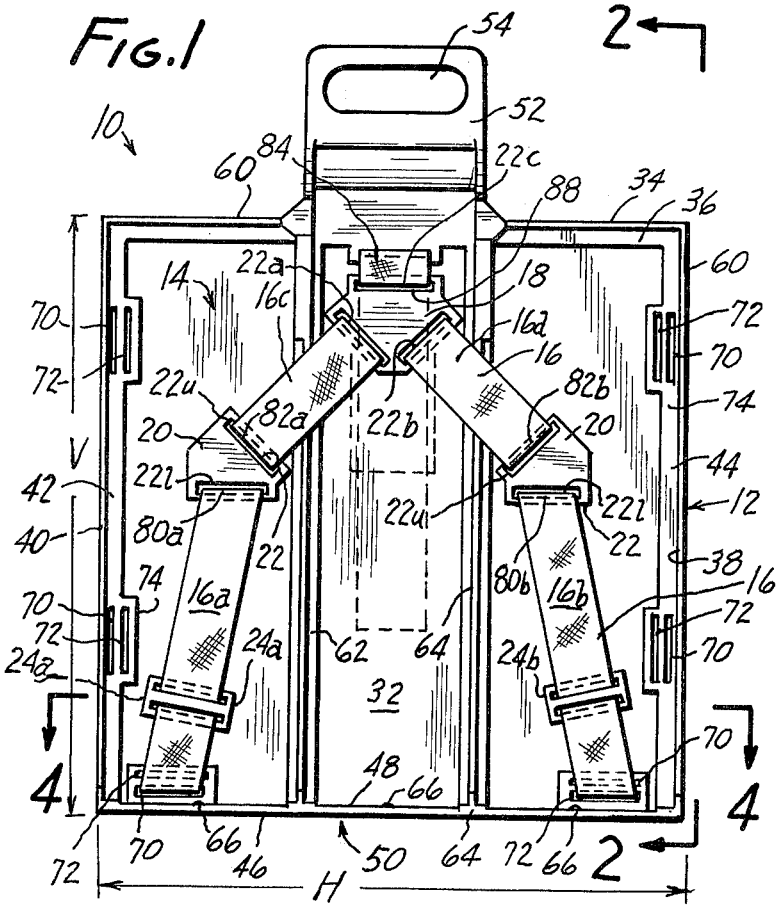
FIG. 1 is a view in vertical elevation of the tote.

With reference now to the drawings in detail, the tote is shown at 10 and comprises a rack in the form of a unitary molded plastic body 12 and a strap assembly 14. The body 12 is composed preferably of a polymer of an olefin of 2 to 4 carbon atoms, such as polyethylene or polypropylene, or an olefin- or rubber-modified styrene polymer, or other tough synthetic organic polymer which is moldable by injection or vacuum formable, resistant to cracking, has a high tenstile modulus, and is relatively low in cost. The strap assembly 14 comprises a series of tough woven webs 16, intermediate plates 18, 20 having relatively angularly disposed, web engaging slots 22, and buckles 24 for purposes to appear.

The rack body 12 comprises a wall portion 32 which is generally rectangular having a normally vertical extension V and a normally horizontal extension H which extensions are sized to enable carrying of the tote 10 by an adult with adequate lateral and vertical support for intended loads. The body wall portion 32 has a top 34, a top edge margin 36, sides 38, 40 and side edge margins 42, 44 respectively and bottom edge 46 and bottom edge margin 48. The rack body 12 further comprises a foot portion 50 projecting outwardly as shown.

The outward extension of the foot portion 50 is typically about 4 inches from the wall portion 32, where the wall portion 32 has a vertical dimension of about 16 inches and a horizontal dimension of about 16 inches.

The wall portion 32 is surmounted by a handle 52 formed integrally with the wall portion on a curvilinear continuation of the wall portion which invertedly arches over the foot portion 50 to cantilever the handle out from the wall portion, above the wall portion as shown, and about intermediate the outward extension of the foot portion. In this manner, the handle when grasped is comfortably away from the leg and closer to the center of gravity of the loaded tote 10 than would be the case where the handle is in the plane of the wall portion as is the case in certain of the prior art devices discussed above. Typical dimensions of the handle 52 include a width of 5 inches, a hand grip opening 54 centered about 3 inches from the top wall 34 of the wall portion 32 and an offset of about 2 inches from the plane of the wall portion 32.

The wall portion 32 is reinforced for rigidity and strength with minimum use of plastic material by use of a stepped perimetrical rib 60 about wall portion sides 38, 40 and top 36. In addition, centrally disposed stepped ribs 62, 64 extend along the vertical extent V of the wall portion 32, and along the horizontal projection of foot portion 50. The foot 50 is further provided with intermediate ribbing 66 between the ribs 62, 64, and at the continuation on the foot of the perimetrical rib 60, and between that rib and the ribs 62, 64, whereby the foot is stiffened across its extent and provided with protection against scrapes and scratches from loads thereon.

Figure 3:
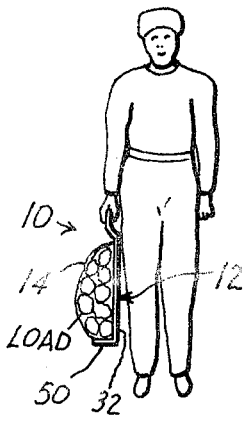
FIG. 3 is a perspective view of the tote in use to haul firewood.
Figure 4:
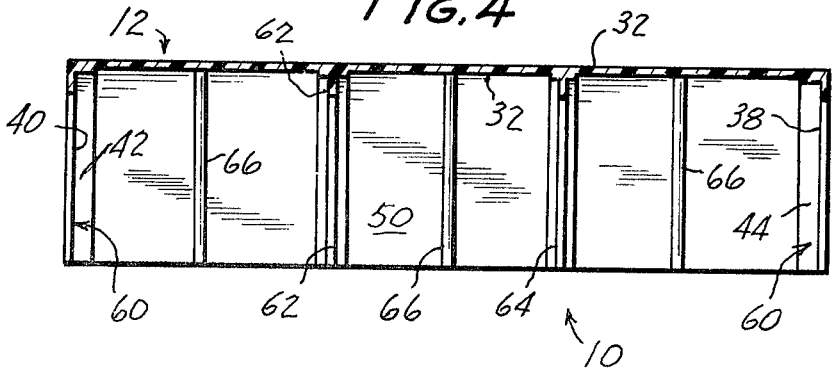
FIG. 4 is a horizontal sectional view of the rack taken on line 4—4 in FIG. 1.

The wall portion 32 is further provided with strap engaging means in the form of peripherally distributed apertures 70 which are formed in the edge margins 36, 40, 44 and 48 of the wall portion, the margins being of increased cross-section all about the apertures for increased strength. Within the apertures 70, strap retainers in the form of retaining bars 72 are provided, each bifurcating its aperture longitudinally inset some from the step 74 of the perimetrical rib 60 as shown. It has been found that placement of the strap retaining bars 72 wholly within the plane of the wall portion 32, enables carrying of heavy loads without buckling of the foot portion 50 as might occur if strapping of the load involved the foot portion. Instead, even as the foot portion underlies and supports a load, see FIG. 3, the strap assembly 14 does not rely on the foot portion to bind the load.

Figure 2:
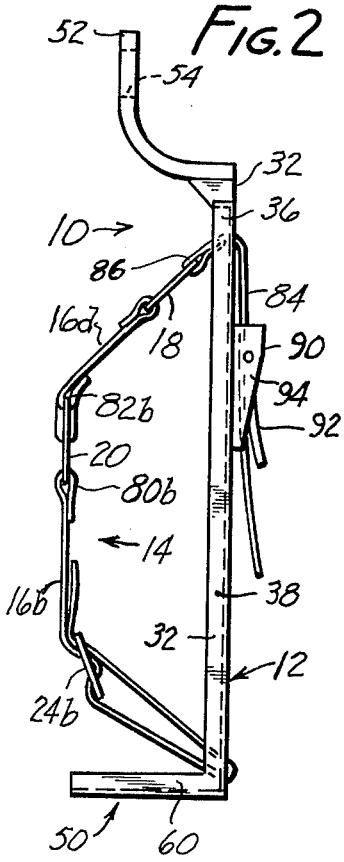
FIG. 2 is a view in side elevation thereof taken on line 2—2 in FIG. 1.

The above-described tote molded body 12 cooperates with strap assembly 14 for carriage of loads without difficulty. With reference now particularly to the strap assembly 14, a pair of lower webs 16*a*, 16*b* are looped around respective retainer bars 72 and their free ends passed through buckles 24*a*, 24*b* whereby the webs bind against themselves in slip-proof relation. Webs 16*a*, 16*b* have sewn, permanently sized loops 80*a*, 80*b* at their opposite ends which engage the lower slots 22L in plates 20 respectively as shown. The plates 20 have upper slots 22U as well which are angularly related to the lower slots 22L so that the webs 16*a*, 16*b* may fully engage the retainer bars 72 at the wall portion bottom edge margin 48 although the webs extend angularly across the wall portion 32, as shown. The plates 20 are engaged at their upper slots 22U with sewn, fixed loops 82*a*, 82*b* of upper webs 16*c*, 16*d* which link the plates 20 to plate 18. Plate 18 defines triangularly disposed slots 22*a*, 22*b*, 22*c*, the former two being coupled to the upper webs 16*c*, 16*d*, and the last being coupled to adjustable web 84 at sewn loop 86. The free end of adjustable web 84 passes through wall portion slot 88 and behind the wall portion into friction fastener 90, best seen in FIG. 2. As will be apparent, the fastener 90 has a pivoted cam 92 which cooperates with bracket 94 to pinch the web in retaining relation, as shown in FIG. 2.

Important features of the strap assembly 14 thus described include the plates 18, 20 lying flat upon the load, and having relatively angled slots so that the webs lie flat although angled across the wall portion 32, and free of kinking and twisting at their juncture with the wall portion and the plates 18, 20.

Moreover, the strap assembly 14 lies flat in any adjustment of the assembly for small or large loads. In practice the strap assembly is loosened or slipped from slot 88, the load installed and the strap assembly tightened by pulling on web 84, and locking down the fastener 90 thereon. To release, the procedure is reversed. It has been found that heavy loads, bulky loads and the like are readily handled when bound upon the tote 10, and that a substantial improvement in aids for carrying such loads has been provided by the above-described invention.

I claim:

1. A tote for carrying bulky, heavy and/or oddly shaped loads, comprising a rack and strap assembly adapted to support a load being carried by hand alongside a user's leg, said rack being a unitary molding of high strength synthetic organic plastic and comprising a normally upright, generally rectangular, wall portion having a top and a top edge margin adjacent thereto, side edges and side edge margins adjacent thereto, and a bottom edge and a bottom edge margin adjacent thereto, a foot portion integrally formed with and normally projecting outwardly from said wall portion bottom edge for supporting a load to be carried, and a handle integrally formed with and cantilevered from the top edge of said wall portion offset from the plane of said wall portion to overlie said foot portion; strap retaining means being formed in the wall portion top and bottom edge margins; said strap being retained at said retaining means in length adjustable relation for urging a load against said wall portion in foot portion supported relation, whereby bulky, heavy and oddly shaped loads are supported and balanced on said rack for easy carrying.

2. Tote according to claim 1, in which said handle extends vertically above said wall portion top, and including also a continuation of said wall portion extending upwardly beyond said wall portion to said handle to support the same in cantilevered relation.

3. Tote according to claim 1, in which said strap retaining means comprise cooperating sets of web-passing apertures defined in said wall portion at spaced locations enabling encircling of a load by said strap web means in retained relation.

4. Tote according to claim 1, in which said rack wall portion defines a series of angularly related fixed retainers as said retaining means for said strap web means, said strap web means comprising a series of flat web sections and coupling plates therefor adapted to interconnect said web sections in fixed retainer-determined angular relation against twisting and kinking of said web sections when binding said load to said rack.

5. Tote according to claim 1, including also a strap fastener means carried by said wall portion for releasably retaining more or less of said strap web means in load-binding relation.

6. Tote according to claim 1, including also side and top edge margin flanges reinforcing said wall portion against edge flexing, and central rib means reinforcing said wall portion against flexing between said flanges.

7. Tote according to claim 6, including also increased cross-section at said top and bottom edge margins of said wall portion, said retainers being defined within said edge margins of increased cross-section.

8. Tote according to claim 7, in which the central rib reinforced portion of said wall portion has an upward and outward continuation defining a support for said handle.

9. Tote according to claim 8, in which said wall portion defines a perimetrically distributed series of retainers including a retainer adjacently below said continuation at the wall portion top edge margin, and additional retainers at the wall portion bottom edge margin adjacently above said foot portion, said additional retainers being defined by spaced, strap passing apertures in said wall portion edge margins.

10. Tote according to claim 9, in which said strap comprises a first section and a fastener therefor at said top edge margin, second and third strap sections looped respectively around left and right bottom edge margin retainers, and means buckling said second and third sections in looped connection with said retainers.

11. Tote according to claim 10, in which said first section fastener comprises a friction buckle mounted to the back of said wall portion adapted to bind said first strap section to said wall portion anywhere along the length of said first section whereby said strap is length adjustable in secured relation.

12. Tote according to claim 10, in which said first, second and third strap sections are relatively triangularly disposed, and including also a floating plate interconnecting said strap sections in said triangular relation, said plate and said strap sections engaging said load for toting.

13. Tote according to claim 12, in which said second and third strap section retainers lie parallel with said wall portion bottom edge margin and said strap sections extend angularly across said wall portion, and including also means maintaining said second and third strap sections flat against said load and free of twists and kinks, said means comprising secondary plates interposed between adjacent segments of said strap sections to define an angular interconnection between said segments enabling said segments to lie flat against said load and to fully engage said section retainers across the width of said strap section.

14. Tote for carrying bulky, heavy and/or oddly shaped loads, comprising a rack and strap assembly, said strap assembly including a plurality of woven webs articulated along their length to angularly traverse said load but meet said rack at right angles in the plane of said web and lie flat upon said load free of twisting and kinking; said rack comprising a molded generally planar body having a bottom edge flange adapted to underlie a load in supporting relation, and a top edge handle offset from the plane of said rack body to carry said load in cantilevered relation, said rack body having a perimetrical rib at the sides and top thereof, and a pair of central ribs running from said handle to said bottom edge flange, said perimetrical side ribs and said central ribs continuing across said flange in reinforcing relation, a plurality of strap retainers at the top, bottom and side edge margins of said rack body comprising a bar adapted to be looped with said strap webs, buckle means adjustably securing said webs to themselves in looped relation, and a releasable lock for lengthwise adjusting said strap free of adjusting said buckle means, said lock being positioned on the back side of said rack body and adapted to receive a strap web tab in adjustable locking relation.

* * * * *